United States Patent [19]

Brennan

[11] Patent Number: 5,046,860

[45] Date of Patent: Sep. 10, 1991

[54] REUSABLE SHOPPING BAG ASSEMBLY

[75] Inventor: Timothy P. Brennan, Van Nuys, Calif.

[73] Assignee: New Hero, Incorporated, No. Hollywood, Calif.

[21] Appl. No.: 561,808

[22] Filed: Aug. 2, 1990

[51] Int. Cl.[5] ..... B65D 30/22

[52] U.S. Cl. ..... 383/38; 383/6; 383/37; 383/39; 150/111; 150/112

[58] Field of Search ..... 383/6, 37, 38, 39, 40; 190/108, 109; 150/111, 112

[56] References Cited

U.S. PATENT DOCUMENTS

| | | |
|---|---|---|
| 560,469 | 5/1896 | Butts et al. . |
| 2,473,429 | 6/1945 | Hinman . |
| 2,654,527 | 7/1950 | Geckler et al. . |
| 4,078,595 | 3/1978 | Mittelmann . |
| 4,542,826 | 9/1985 | Adams . |
| 4,793,532 | 12/1988 | Cash . |
| 4,867,215 | 9/1989 | Macieowitz . |

*Primary Examiner*—Stephen Marcus
*Assistant Examiner*—Jes F. Pascua
*Attorney, Agent, or Firm*—Pretty, Schroeder, Brueggemann & Clark

[57] ABSTRACT

An inexpensive, washable, reusable shopping bag assembly includes a flexible woven fabric primary bag and a plurality of flexible woven fabric auxiliary bags that are substantially equal in size to the primary bag. The primary bag includes a plurality of compartments or pockets storing the auxiliary bags so that they can be removed as necessary and used to store and carry shopping items. The primary bag itself may also be used to carry shopping items.

59 Claims, 2 Drawing Sheets

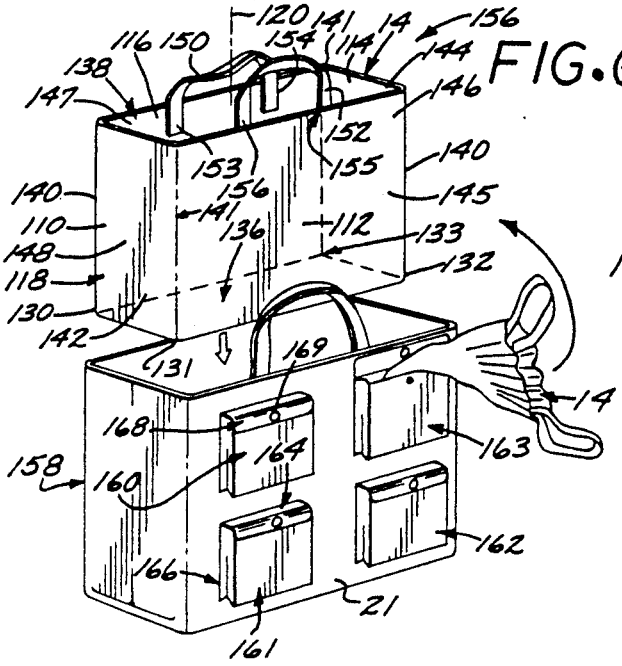
FIG.6
FIG.7
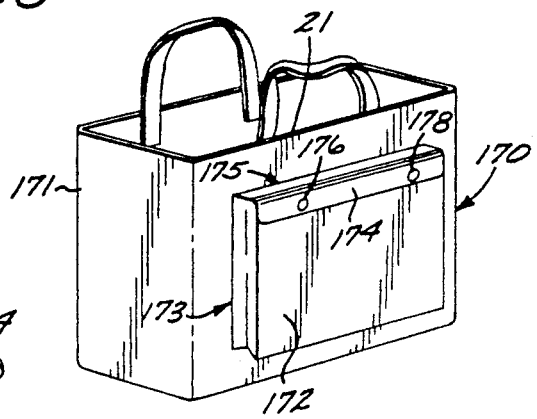
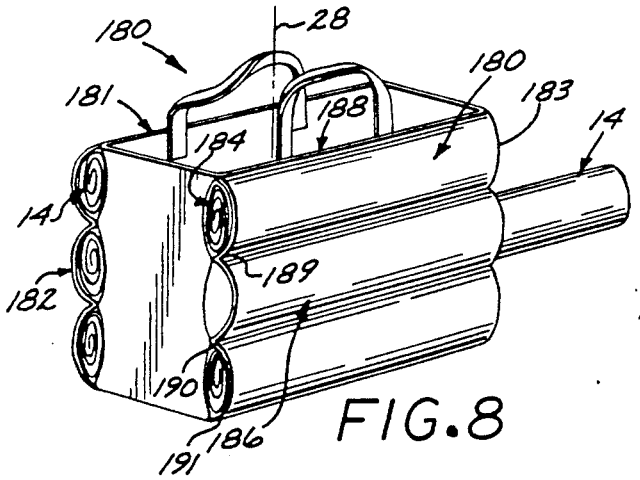
FIG.8
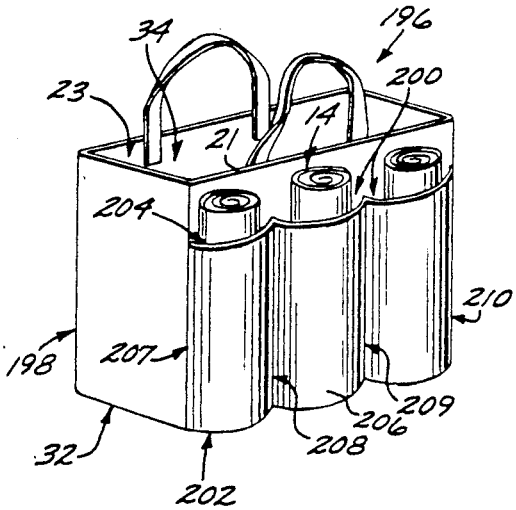
FIG.9
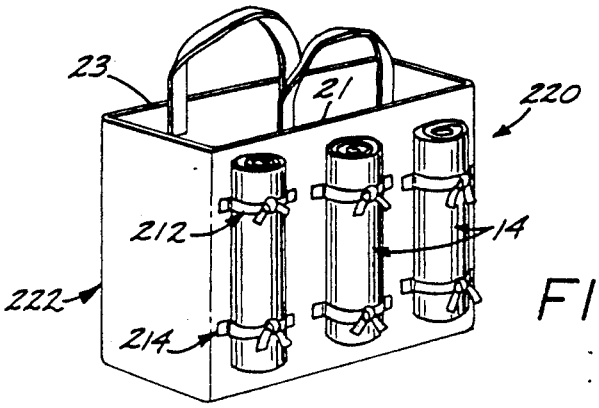
FIG.10

REUSABLE SHOPPING BAG ASSEMBLY

BACKGROUND OF THE INVENTION

This invention relates to reusable shopping bag assemblies and more particularly to a reusable shopping bag which can be used to carry purchased items and which also provides one or more storage compartments around its interior, each of which store another similar reusable shopping bag, so that a shopper does not have to use disposable plastic or paper shopping bags.

Presently, consumers are given disposable paper or plastic bags by stores to carry their purchased goods. The manufacture and disposal of these paper and plastic bags places a great burden on the environment. For instance, timber, from already depleted forests must be used to manufacture paper bags. Furthermore, a great deal of energy from already depleted energy sources must be used to manufacture these paper and plastic bags. The manufacture of the paper and plastic bags also creates air and water pollution in an already polluted world. Finally, the disposal of the paper and plastic bags places a great burden on already overflowing landfills, especially since most plastic bags are not biodegradable. The public has become increasingly aware of the environmental problems that technology has created.

Although reusable shopping bag assemblies have been developed over the years they have been slow to attain universal popularity. Some of these reusable shopping bag assemblies have compartments either in their interior or on their exterior. The reusable shopping bags are not, however, designed to carry a number of similar reusable shopping bags in their compartments in addition to providing storage for purchased items. They are thus not convenient when used while shopping for groceries or other items where several shopping bags full of goods are purchased at one time.

For instance, U.S. Pat. No. 2,654,527 to Geckler et. al. discloses a compartment bag. The Geckler compartment bag comprises a main body and an independent pocket exterior to the main body. The size of the exterior pocket is not affected by the insertion of shopping items into the main body. While the Geckler compartment bag is generally satisfactory for single bag storage, it does not provide the convenience of multiple bags stored within a single bag. For example, there is no provision for a similar bag that can be stored in the exterior pocket of the bag and removed so that additional shopping items may be placed therein. Even if there was such a provision, the main pocket is not designed so that it could stand alone as the similar bag is placed therein and is filled with shopping items.

U.S. Pat. No. 4,867,215 to Macieowitz discloses a utility bag having a recessed compartment. The patent discloses a utility bag which has a smaller bag connected to the interior of the utility bag in such a way that even when full, it is virtually invisible from the outside. Thus, valuables may be stored in the interior bag without the threat that the valuables could be spotted by a thief. There is no provision for a similar utility bag that can be stored in the interior compartment. The interior bag disclosed by Macieowitz is too small to serve as a full size shopping bag.

SUMMARY OF THE INVENTION

A reusable shopping bag assembly in accordance with the present invention includes a flexible fabric primary shopping bag for carrying purchased items and having a plurality of elongated storage compartments mounted thereon, each compartment storing a similar flexible fabric bag that can be removed and used to store and carry additional purchased items. The invention enables a shopper to use his or her own shopping bag in place of the disposable paper or plastic bags typically provided by a store. Not only does the shopper enjoy the convenience of a plurality of strong shopping bags with carrying handles, but the environmental damage that comes from manufacturing and disposing of paper and plastic bags is reduced.

The invention utilizes primary and secondary bags formed from a sturdy flexible woven fabric defining a base and a side wall. The side wall forms a tube that is connected to the base at one end to form a bag which has a closed end at the base and an opposite open end to form a hollow interior. A pair of carrying handles are connected to the edge of the side wall adjacent the open end.

One or more compartments are sewn to the side wall and store secondary bags. The compartments are preferably made of the same flexible woven fabric as the bags and extend along the sidewall of a primary bag from the closed end at the base to the opposite open end or mouth. Each compartment is large enough to store at least one auxiliary bag. An y portion or all of the bag assembly can be machine washed if it should become soiled and the assembly is readily folded and stored in a relatively small space.

BRIEF DESCRIPTION OF THE DRAWINGS

A reusable shopping bag assembly, constructed in accordance wit the invention is illustrated in the accompanying drawings in which:

FIG. 6 is a perspective view of an alternative embodiment of a shopping bag assembly in accordance with the invention;

FIG. 7 is a perspective view of an alternative embodiment of a shopping bag assembly in accordance with invention;

FIG. 8 is a perspective view of a further alternative embodiment of a shopping bag assembly in accordance wit the invention;

FIG. 9 is a perspective view of another embodiment of a shopping bag assembly in accordance with the invention; and FIG. 10 is a perspective view of a further embodiment of a shopping bag assembly in accordance with the invention.

DETAILED DESCRIPTION OF THE PREFERRED EMBODIMENTS

Figure 1:
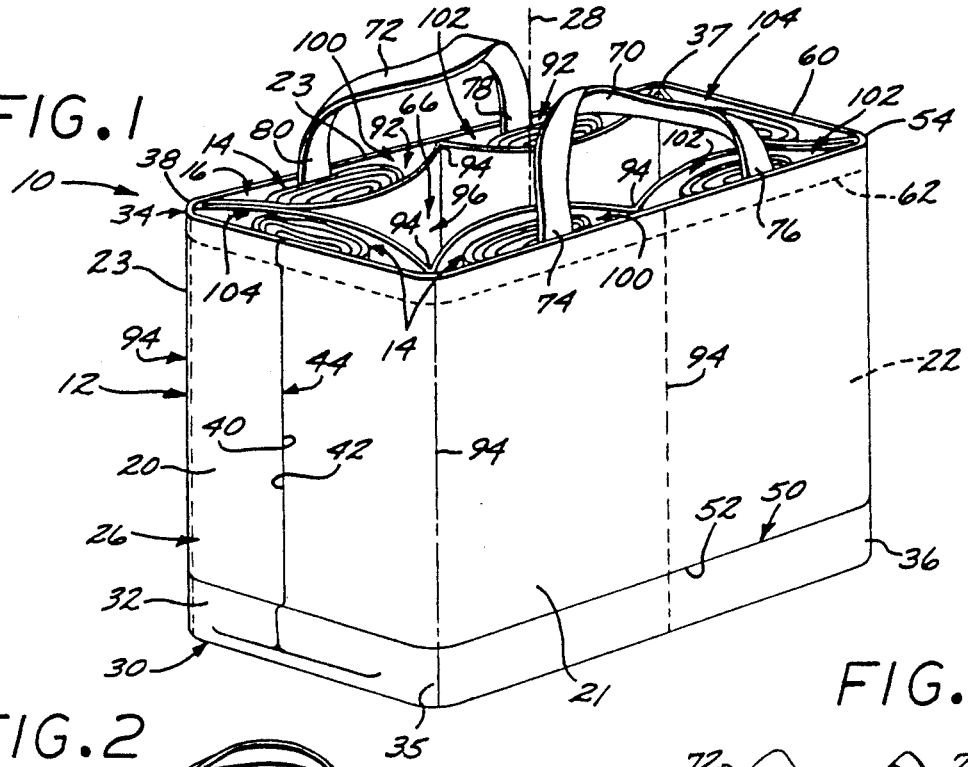
FIG. 1 is a perspective view of the shopping bag assembly in accordance with the invention.
Figure 2:
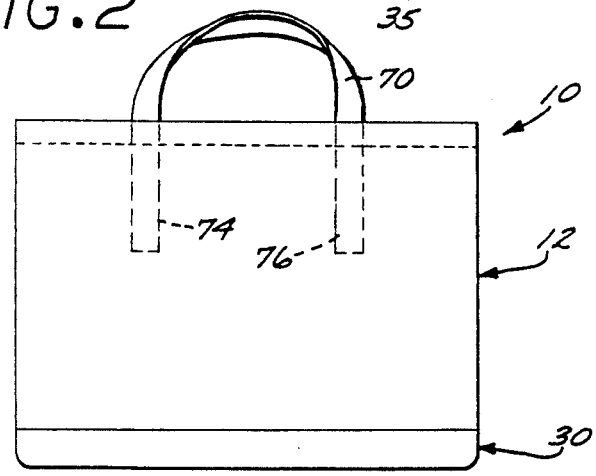
FIG. 2 is a front elevational view of a primary bag use din the shopping bag assembly shown in FIG. 1.
Figure 3:
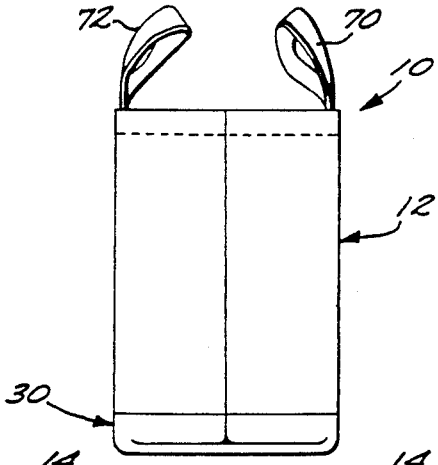
FIG. 3 is a side elevational view of a primary bag used in the shopping bas assembly shown in FIG. 1.
Figure 4:
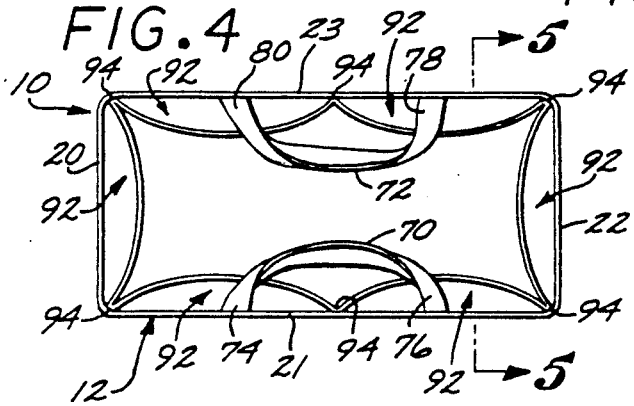
FIG. 4 is a top plan view of a primary bag used in the shopping bag assembly shown in FIG. 1.
Figure 5:
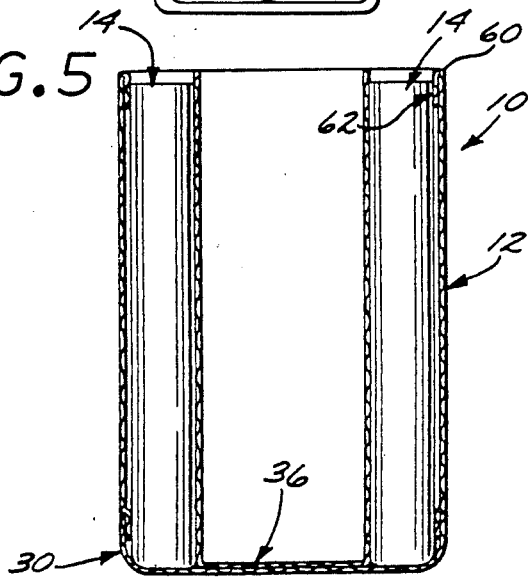
FIG. 5 is a cross-sectional view taken along line 5—5 of the shopping bag assembly as shown in FIG. 4.

Referring now to FIG. 1, a low cost, environmentally sound reusable shopping bag assembly 10 in accordance with the invention includes a primary bag 12 storing at least one auxiliary bag 14 that is similar in size and construction to the primary bag 12. The primary bag 12 is formed from a flexible woven fabric material such as a heavy cotton canvass duck.

The primary bag 12 has four generally rectangular side wall panels 20, 21, 22, and 23 forming a tubular side wall that extends along a central axis 28. A rectangular end panel 30 is secured to the side wall 26 at one end 32 and the opposite end 34 is left open to form a mouth. The side wall 26 is preferably formed from a rectangular piece of fabric that is folded at corners 35, 36, 37, and 38 and closed upon itself to allow opposite edges 40, 42 to be sewn together along axially extending seam 44 to form a rectangular cross-sectioned tube.

The side wall 26 is sewn to the base along circumferentially extending seam 50 adjacent a bottom long edge 52 of the side wall 26. An opposite, top long edge 54 of the side wall 26 is folded down and inward along a circumferentially extending fold line 60 and sewn to the side wall 26 to create a strengthening and stiffening hem 62. The tube formed by the side wall 26 thus has a closed bottom end 32 at the base and an opposite open end or mouth 34 to define a half open flexible tube structure having a hollow interior 66 for receiving and carrying shopping items.

A pair of elongated woven fabric carrying handles 70, 72 are connected to opposite sides of the side wall 26 adjacent the open end 34. Each handle 70, 72 has opposite ends 74, 76, 78 and 80 respectively, secured to side wall 26 to form a flexible loop that is easily extended when the bag 12 is carried or folded inside bag 12 for convenient storage.

An interior flexible woven fabric bag 90 of substantially the same size and shape as the primary bag 12 is inserted and secured into the hollow interior 66 to reinforce the primary bag and to form six elongated storage compartments 92. The interior bag is stitched to the primary bag at six equally-spaced seams 94, which extend axially between the base 32 of the primary bag and the mouth 34 of the primary bag. The seams 94 are peripherally positioned at each of the four corners and midway along each of the side panels 21, 23. In addition to forming the storage compartments 96 the seams 94 secure together multiple layers of material and serve as stiffening elements or stays that give the side wall 26 sufficient stiffness that primary bag 12 can stand by itself with the mouth open to receive shopping items.

The six axially extending elongated storage compartments 92 are each formed by the portion of the side wall 96 of the interior bag between two of the seams. The elongated storage compartments 92 are distributed about the interior surface of the primary bag 16 with two of the compartments 100, 102 being secured in side by side relationship to each of the side panels 21, 23 and one compartment 104 being secured to each end panel 22,24. Each elongated storage compartment 92 extends from the closed end 32 adjacent the base 30 of the primary bag 12 to an open end 34 at the mouth. Each compartment is large enough to store one auxiliary bag 14. The base of the interior bag 36 thus acts as an inner base for the primary bag whereas the base of the primary bag 30 acts as an outer base.

Referring now to FIG. 6, the flexible woven fabric auxiliary bags 14 are substantially equal in size and shape to the primary bas 12. The flexible woven fabric auxiliary bags have four generally rectangular side wall panels 110, 112, 114, and 116 forming a tubular side wall 118 that extends along a central axis 120. The side wall 118 is preferably formed from a rectangular piece of fabric that is folded at four points 130, 131, 132, and 133 at its middle to form the closed bottom 136 of the auxiliary bag. Sewn to edges 140, 141 of the rectangular piece of fabric are two smaller rectangular flexible woven fabric 142, 144 which form the end panels of the auxiliary bag. The tubular side wall formed by the three pieces of rectangular woven fabric has four side panels 145, 146, 147, 148 and has base 138 adjacent open end or mouth 138.

A pair of elongated woven fabric carrying handles 150, 152 are connected to opposite sides of the side wall 118 adjacent the open end 138. Each handle 150, 152 has opposite ends 153, 154, 155, and 156 respectively, secured to side panels 145, 147 to form a flexible loop that is easily extended when the auxiliary bag 14 is carried or folded inside auxiliary bag 14 for convenient storage.

Referring now to FIG. 6, an alternative embodiment of a shopping bag assembly in accordance with the invention includes a shopping bag assembly 156 having a primary bag 158 and a plurality of secondary bags 14. Each primary bag 158 stores one secondary bag 14 in telescoping relationship and includes rectangular flexible woven fabric pockets 160, 161, 162, and 163. Each rectangular flexible woven fabric pocket is large enough to store one auxiliary bag 14. Each rectangular flexible woven fabric pocket 160–163 is stitched to an exterior side panel surface 21 along a seam 166. The rectangular flexible woven fabric pockets 160–163 have a flexible woven fabric cover 168 stitched to the exterior side panel surface along a seam 164 and can be secured to the pocket by a snap 169.

Referring now to FIG. 7, shopping bag assembly 170 in accordance with the invention includes primary bag 171 having a rectangular flexible woven fabric pocket 172. The rectangular flexible woven fabric pocket 172 is large enough to store more than one auxiliary bag 14 and is stitched to the exterior side wall surface 21 of the primary bag along seam 173. The rectangular flexible woven fabric pocket 172 has a flexible woven fabric cover 174 stitched to the exterior side panel surface along seam 175 and can be secured to the pocket 172 by snaps 176, 178.

Referring now to FIG. 8, a still further embodiment of a shopping bag assembly in accordance with the invention includes a shopping bag assembly 180 having a primary bag 181 and a plurality of auxiliary bags 14. The primary bag 180 includes six elongated storage compartments 182, which ar formed on the exterior of each of two of the side panels 21, 23 of the primary bag 180. There are three laterally extending elongated storage compartments on each of the side panels. The elongated storage compartments 182 each extend in a direction perpendicular to the axis 28 of the primary bag 12 for the length of the side panel and have a mouth at each one of its ends 183, 184. The elongated storage compartments are formed from a rectangular piece of flexible woven fabric 186 which is stitched to the side panels along seams 188, 189, 190, and 191. Each elongated storage compartment is large enough to store one auxiliary bag 14.

Referring now to FIG. 9, a shopping bag assembly 196 in accordance with a further embodiment of the invention includes a primary bag 198 and a plurality of auxiliary bags 14 stored therein The primary bag 198 has six elongated storage compartments 200, which are formed on the exterior surface of the side panels 21, 23 of the primary bag 198. (Three of the storage compartments 200 are on the back panel 23 and are not visible in FIG. 9.) There are three elongated storage compartments 200 on each of the side panels. The elongated storage compartments extend axially from a closed end 202 adjacent the base 32 of the primary bag 198 to an open end 204 adjacent the mouth of the primary bag 34. The elongated storage compartments are formed from a rectangular piece of flexible woven fabric 206 which is stitched to the side panels along seams 207, 208, 209 and 210. Each elongated storage compartment 200 is large enough to store one auxiliary bag 14

Referring now to FIG. 10, an arrangement of a shopping bag assembly 220 in accordance with the invention includes a primary bag 222 and a plurality of auxiliary bags 14. Primary bag 222 includes twenty-four flexible woven fabric tying ribbons 212 which are sewn at their end 214 onto the exterior surface of the side panels 21, 23 of the primary bag 12. There are two horizontal rows of six tying ribbons 212 each sewn onto each of the side panels. The tying ribbons 212 can secure an auxiliary bag 14 to the side panel by tying one pair of ribbons 212 from each row together around the auxiliary bag.

One of the shopping bag assemblies in accordance with the invention may be carried to a store by a shopper with the auxiliary bags 14 stored in the elongated storage compartments To place the shopper's purchased items into the shopping bag assembly, the shopper removes one of the auxiliary bags from its elongated storage compartment and places it into the hollow interior 66 of the primary bag. The primary bag is self-standing, thus allowing the auxiliary bag to be filled with purchased items when placed in the hollow interior of the primary bag. When the auxiliary bag is filled with purchased items, the shopper removes it from the hollow interior of the primary bag and replaces it with another auxiliary bag. The shopper then repeats this process until the last of the purchased items are placed into the hollow interior of the primary bag. Even with all of the auxiliary bags in the elongated storage compartments, there is still room in the hollow interior of the primary bag for carrying purchased items.

Upon returning home following a shopping trip, the shopper removes the purchased items from the primary and auxiliary bags The auxiliary bags are then returned to their elongated storage compartments The primary and auxiliary bags are reusable and may be washed when they become soiled.

While there have been shown and described above various embodiments of shopping bag assemblies in accordance with the invention for the purpose of enabling a person of ordinary skill in the art to make and use the invention, it will be appreciated that the invention is not limited thereto Accordingly, any modifications, variations of equivalent arrangements within the scope of the attached claims should be considered to be within the scope of the invention.

I claim:

1. A reusable shopping bag assembly comprising:

a primary bag having a flexible base and a flexible side wall forming a closed surface defining an axially extending tube having first and second ends and opposite interior and exterior surfaces, the base being secured to the side wall at the first end to close the first end of the tube with the second end being open and forming a mouth, a carrying handle secured to the side wall at the mouth and a plurality of elongated compartments secured to the side wall, each compartment having a length that is substantially equal to an axial length of the side wall between the first and second ends and having sufficient capacity to store at least one auxiliary bag; and a plurality of auxiliary bags that are substantially equal in size and shape to the primary bag, each auxiliary bag having a carrying handle and being stored in one of the elongated compartments for subsequent removal and filling with shopping items

2. A reusable shopping bag assembly according to claim 1 wherein said primary bag has the base, side wall, and carrying handle thereof formed from a flexible woven fabric.

3. A reusable shopping bag assembly according to claim 1 wherein the base of said primary bag is rectangular and said auxiliary bag has a base that is rectangular

4. A reusable shopping bag assembly according to claim 1 wherein the side wall of said primary bag is formed from a rectangular section of flexible woven fabric having opposite ends coupled together to form a tube

5. A reusable shopping bag assembly according to claim 1 wherein the side wall of said primary bag is comprised of four rectangular side wall panels that are coupled together

6. A reusable shopping bag assembly according to claim 1 wherein the base of said primary bag is comprised of inner and outer rectangular sections of flexible woven fabric coupled together

7. A reusable shopping bag assembly according to claim 1 wherein said primary bag has a plurality of equally-spaced seams along its side wall which extend axially between its base and its mouth and which act as a stiffening agent so that said primary bag is selfstanding.

8. A reusable shopping bag assembly according to claim 1 wherein said elongated compartments are coupled to the exterior surface of the side wall of said primary bag, said elongated compartments extending in a direction perpendicular to the axis of the side wall of said primary bag.

9. A reusable shopping bag assembly according to claim 1 wherein said elongated compartments are secured to the exterior surface of the side wall of said primary bag

10. A reusable shopping bag assembly according to claim 1 wherein said elongated compartments are secured to the interior surface of the side wall of said primary bag.

11. A reusable shopping bag assembly according to claim 1 wherein said elongated compartments are comprised of a plurality of rectangular pockets, each rectangular pocket being coupled to the exterior surface of the side wall of said primary bag and being capable of storing at least one auxiliary bag.

12. A reusable shopping bag assembly according to claim 1 wherein said elongated compartments each define exactly one rectangular pocket, said rectangular pocket being coupled to the exterior surface of the side wall of said primary bag and being capable of storing a plurality of auxiliary bags.

13. A reusable shopping bag assembly according to claim 1 wherein said elongated compartments each include a plurality of ribbons which are coupled to the exterior surface of the side wall of said primary bag, said ribbons being spaced in two horizontal rows such that an auxiliary bag is secured to the side wall by tying one pair of ribbons from each row around the auxiliary bag that is being secured 14. A reusable shopping bag assembly comprising:

a primary bag having a flexible woven fabric bottom wall, a flexible woven fabric side wall extending axially between first and second opposite ends, the side wall being peripherally closed to form a hollow tube having opposite interior and exterior surfaces, the bottom wall being secured to and closing the first end and the second end being open to form a mouth, the primary bag further having a pair of opposed loop handles secured to the side wall at the mouth of the primary bag, and a plurality of elongated compartments formed on the interior surface of the side wall and extending axially from the bottom wall to the mouth, each elongated compartment having an open end adjacent the mouth of the primary bag and being sufficiently large to receive through the open end and store an auxiliary bag that is substantially equal in size to the primary bag the primary bag being capable of receiving and storing shopping items even when each of the elongated compartments has an auxiliary bag stored therein; and a plurality of flexible woven fabric auxiliary bags each having an open mouth, and a rectangular bottom wall and side walls projecting upwardly from said bottom wall in substantially right angular relation transversely of the bag and terminating in free edges defining a normally open end, a pair of opposed loop handles secured to the mouth, each auxiliary bag being stored in a different one of the elongated compartments of said primary bag for subsequent removal from the open end of the compartment and filling with shopping items.

15. A reusable shopping bag assembly according to claim 14 wherein the bottom wall of said primary bag is rectangular and said auxiliary bag has a bottom wall that is rectangular 16. A reusable shopping bag assembly according to claim 14 wherein the side wall of said primary bag and said auxiliary bags is formed from a rectangular section of flexible woven fabric having opposite ends coupled together to form a tube.

17. A reusable shopping bag assembly according to claim 14 wherein the side wall of said primary bag is comprised of four rectangular side walls coupled together.

18. A reusable shopping bag assembly according to claim 14 wherein the bottom wall of said primary bag is comprised of inner and outer rectangular sections of flexible woven fabric coupled together.

19. A reusable shopping bag assembly according to claim 14 wherein said primary bag has a plurality of equally-spaced seams along its side wall extending axially between its bottom wall and its mouth and which act as a stiffening agent so that said primary bag is self-standing 20. A reusable shopping bag assembly according to claim 14 wherein said elongated compartments are coupled to the exterior surface of the side wall of said primary bag, said elongated compartments extending in a direction perpendicular to the axis of the side wall of said primary bag.

21. A reusable shopping bag assembly according to claim 14 wherein said elongated compartments are secured to the exterior surface of the side wall of said primary bag.

22. A reusable shopping bag assembly according to claim 14 wherein said elongated compartments are comprised of a plurality of rectangular pockets, said rectangular pockets being coupled to the exterior surface of the side wall of said primary bag and being capable of storing at least one auxiliary bag.

23. A reusable shopping bag assembly according to claim 14 wherein said elongated compartments each define exactly one rectangular pocket, said rectangular pocket being coupled to the exterior surface of the side wall of said primary bag and being capable of storing a plurality of auxiliary bags.

24. A reusable shopping bag assembly according to claim 14 wherein said elongated compartments each include a plurality of ribbons which are coupled to the exterior surface of the side wall of said primary bag, said ribbons being spaced in two horizontal rows such that an auxiliary bag is secured to the side wall by tying one pair of ribbons from each row around the auxiliary bag that is being secured 25. A reusable shopping bag assembly comprising:

a flexible woven fabric primary bag including:

a rectangular bottom wall, four rectangular side walls each having opposite interior and exterior surfaces and being joined to another side wall along axially extending edge to form a rectangular tube, the tube being coupled to and closed by the bottom wall at one end and having an open second end defining a mouth, a pair of carrying handles coupled to the side walls adjacent the mouth, a plurality of elongated compartments each secured to an interior surface of one of said side walls and defining a mouth that is coterminous with the mouth of the primary bag, each compartment having an inner storage area sufficient to contain a flexible woven bag of substantially the same size and shape as said primary bag, the primary bag being available for storing of shopping items even when storing an auxiliary bag in each compartment;

a plurality of flexible woven fabric auxiliary bags, each bag including:

a rectangular bottom wall, four rectangular side walls that each have two opposed axially extending edges and opposed top and bottom edges; the side walls being joined together along their axially extending edges to form a rectangular tube, the tube being secured to and closed by the bottom at one end and forming an open mouth at an opposite second end, each auxiliary bag further including a pair of carrying handles and being stored in one of the elongated compartments for subsequent removal and filling with shopping items 26. A reusable shopping bag assembly according to claim 25 wherein the side wall of said primary bag and said auxiliary bags is formed from a rectangular section of flexible woven fabric having its opposite ends coupled together to form a tube.

27. A reusable shopping bag assembly according to claim 25 wherein the bottom wall of said primary bag is comprised of inner and outer rectangular sections of flexible woven fabric coupled together 28. A reusable shopping bag assembly according to claim 25 wherein said primary bag has a plurality of equally-spaced seams along its side wall which extend axially between its bottom wall and its mouth and which act as a stiffening agent so that said primary bag is self-standing.

29. A reusable shopping bag assembly according to claim 25 wherein said elongated compartments are coupled to the exterior surface of the side walls of said primary bag, said elongated compartments extending in a direction perpendicular to the axis of the side walls of said primary bag.

30. A reusable shopping bag assembly according to claim 25 wherein said elongated compartments are secured to the exterior surface of the side walls of said primary bag.

31. A reusable shopping bag assembly according to claim 25 wherein said elongated compartments are comprised of a plurality of rectangular pockets, said rectangular pockets being coupled to the exterior surface of the side walls of said primary bag and being capable of storing at least one auxiliary bag.

32. A reusable shopping bag assembly according to claim 25 wherein said elongated compartments each form exactly one rectangular pocket, said rectangular pocket being coupled to the exterior surface of the side walls of said primary bag and being capable of storing a plurality of auxiliary bags.

33. A reusable shopping bag assembly according to claim 25 wherein said elongated compartments each include a plurality of ribbons which are coupled to the exterior surface of the side walls of said primary bag, said ribbons being spaced in two horizontal rows such that an auxiliary bag is secured to the side walls by tying one pair of ribbons from each row around the auxiliary bag that is being secured

34. A reusable shopping bag assembly comprising:

a primary bag having a flexible base and a flexible side wall forming a closed surface defining an axially extending tube having first and second ends and opposite interior and exterior surfaces, the base being secured to the side wall at the first end to close the tube with the second end being open and forming a mouth, a carrying handle secured to the side wall at the mouth having a plurality of storage means for storing an auxiliary bag said storage means each secured to the side wall of the primary bag, said primary bag being capable of containing an auxiliary bag of substantially the same size and shape as the primary bag as the auxiliary bag is filled with shopping items, a plurality of auxiliary bags of substantially the same size and shape as said primary bag each auxiliary bag being individually stored in one of said storage means and each of which can be removed and filled with shopping items when placed in the open end of said primary bag.

35. A reusable shopping bag assembly according to claim 34 wherein said primary bag has the base, side wall, and carrying handle thereof formed from a flexible woven fabric.

36. A reusable shopping bag assembly according to claim 34 wherein the base of said primary bag is rectangular and said auxiliary bag has a base that is rectangular.

37. A reusable shopping bag assembly according to claim 34 wherein the side wall of said primary bag is formed from a rectangular section of flexible woven fabric having opposite ends coupled together to form a tube.

38. A reusable shopping bag assembly according to claim 34 wherein the side wall of said primary bag is comprised of four rectangular side walls.

39. A reusable shopping bag assembly according to claim 34 wherein the base of said primary bag is comprised of inner and outer rectangular sections of flexible woven fabric coupled together

40. A reusable shopping bag assembly according to claim 34 wherein said primary bag has a plurality of equally-spaced seams along its side wall which extend axially between its base and its mouth and which act as stiffening agents so that said primary bag is selfstanding.

41. A reusable shopping bag assembly according to claim 34 wherein said storage means comprise elongated compartments coupled to the interior surface of said side wall having a closed end and an open end coterminous with the first and second ends of the side wall respectively

42. A reusable shopping bag assembly according to claim 34 wherein said storage means comprise elongated compartments coupled to the exterior surface of said side wall having a closed end and an open end coterminous with the first and second ends of the side wall respectively.

43. A reusable shopping bag assembly according to claim 34 wherein said storage means comprise elongated compartments coupled to the exterior surface of the side wall of said primary bag, said elongated compartments extending in a direction perpendicular to the axis of said primary bag.

44. A reusable shopping bag assembly according to claim 34 wherein said storage means comprise a plurality of rectangular pockets, said rectangular pockets being coupled to the exterior surface of the side wall of said primary bag and being capable of storing one auxiliary bag.

45. A reusable shopping bag assembly according to claim 34 wherein said storage means comprise exactly one rectangular pocket, said rectangular pocket being coupled to the exterior surface of the side wall of said primary bag and being capable of storing a plurality of auxiliary bags.

46. A reusable shopping bag assembly according to claim 34 wherein said storage means comprise a plurality of ribbons which are coupled to the side wall of said primary bag, said ribbons being spaced in two horizontal rows such that an auxiliary bag is secured to the side wall by tying one pair of ribbons from each row around the auxiliary bag that is being secured

47. A reusable shopping bag assembly comprising a primary bag having a bottom, a side wall having opposite interior and exterior surfaces extending axially between an open mouth and the bottom and a plurality of axially extending pockets secured to the side wall and extending between the bottom and the mouth, and a plurality of auxiliary shopping bags, each being substantially equal in size to the primary bag and being secured within one of the pockets.

48. A reusable shopping bag assembly according to claim 47 wherein said primary bag has the bottom, side wall, and carrying handle thereof formed from a flexible woven fabric.

49. A reusable shopping bag assembly according to claim 47 wherein the bottom of said primary bag is rectangular and said auxiliary bags has a base that is rectangular.

50. A reusable shopping bag assembly according to claim 47 wherein the side wall of said primary bag is formed from a rectangular section of flexible woven fabric having its opposite ends coupled together to form a tube.

51. A reusable shopping bag assembly according to claim 47 wherein the side wall of said primary bag is comprised of four rectangular side walls coupled together 52. A reusable shopping bag assembly according to claim 47 wherein the bottom of said primary bag is comprised of inner and outer rectangular sections of flexible woven fabric coupled together 53. A reusable shopping bag assembly according to claim 47 wherein said primary bag has a plurality of equally-spaced seams along its side wall which extend between its bottom and its mouth and which act as stiffening agents so that said primary bag is selfstanding.

54. A reusable shopping bag assembly according to claim 47 wherein said pockets are coupled to the exterior surface of the side wall of said primary bag, said pockets extending in a direction perpendicular to the axis of said side walls of said primary bag.

55. A reusable shopping bag assembly according to claim 47 wherein said pockets are secured to the interior surface of the side wall of said primary bag.

56. A reusable shopping bag assembly according to claim 47 wherein said pockets are secured to the exterior surface of the side wall of said primary bag.

57. A reusable shopping bag assembly according to claim 47 wherein said pockets are comprised of a plurality of rectangular pockets, each rectangular pocket being coupled to the exterior surface of the side wall of said primary bag and being capable of storing at least one auxiliary bag.

58. A reusable shopping bag assembly according to claim 47 wherein said pockets each define exactly one rectangular pocket, said rectangular pocket being coupled to the exterior surface of the side wall of said primary bag and being capable of storing a plurality of auxiliary bags.

59. A reusable shopping bag assembly according to claim 42 wherein said pockets each include a plurality of ribbons which are coupled to the exterior surface of the side wall of said primary bag, such ribbons being spaced in two horizontal rows such that an auxiliary bag is secured to the side wall by tying one pair of ribbons from each row around the auxiliary bag that is being secured.

* * * * *

UNITED STATES PATENT AND TRADEMARK OFFICE
CERTIFICATE OF CORRECTION

PATENT NO. : 5,046,860

DATED : September 10, 1991

INVENTOR(S) : Timothy P. Brennan

It is certified that error appears in the above-identified patent and that said Letters Patent is hereby corrected as shown below:

On the cover page under References Cited, please add the following:

| | | | | |
|---|---|---|---|---|
| 2,533,725 | 12/1950 | Eisenberg | 383 | 40X |
| RE25,826 | 08/1965 | Ward | 383 | 37X |
| 3,963,102 | 06/1976 | Carp | 150 | 111X |

FOREIGN PATENT DOCUMENTS

| | | | | |
|---|---|---|---|---|
| 628,649 | 09/1949 | United Kingdom | 383 | 6 |
| 80,103 | 04/1952 | Norway | 383 | 6 |

Signed and Sealed this

Fifth Day of January, 1993

*Attest:*

DOUGLAS B. COMER

*Attesting Officer*

*Acting Commissioner of Patents and Trademarks*